US011859873B2

(12) United States Patent
Lee et al.

(10) Patent No.: US 11,859,873 B2
(45) Date of Patent: Jan. 2, 2024

(54) FLUID COOLING APPARATUS

(71) Applicant: SAMSUNG HEAVY IND. CO., LTD, Gyeonggi-do (KR)

(72) Inventors: Donghun Lee, Gyeongsangnam-do (KR); Mungyu Kim, Gyeongsangnam-do (KR); Joonho Min, Gyeongsangnam-do (KR); Hyunki Park, Gyeongsangnam-do (KR); Chihun Lee, Gyeongsangnam-do (KR)

(73) Assignee: SAMSUNG HEAVY IND. CO., LTD, Gyeonggi-Do (KR)

( * ) Notice: Subject to any disclaimer, the term of this patent is extended or adjusted under 35 U.S.C. 154(b) by 12 days.

(21) Appl. No.: 16/311,391

(22) PCT Filed: Jan. 31, 2017

(86) PCT No.: PCT/KR2017/001019
§ 371 (c)(1),
(2) Date: Dec. 19, 2018

(87) PCT Pub. No.: WO2017/222138
PCT Pub. Date: Dec. 28, 2017

(65) Prior Publication Data

US 2019/0195536 A1 Jun. 27, 2019

(30) Foreign Application Priority Data

Jun. 22, 2016 (KR) ..... 10-2016-0078200

(51) Int. Cl.
*F25B 9/06* (2006.01)
*F25J 1/00* (2006.01)
(Continued)

(52) U.S. Cl.
CPC ..... *F25B 1/10* (2013.01); *F25B 3/00* (2013.01); *F25B 9/06* (2013.01); *F25B 31/008* (2013.01);
(Continued)

(58) Field of Classification Search
CPC .. F25B 9/06; F25B 41/00; F25B 31/00; F25B 31/008; F25B 41/003; F25B 2400/14;
(Continued)

(56) References Cited

U.S. PATENT DOCUMENTS 2,652,129 A * 9/1953 Benedict ..... B01D 53/14 95/177
2,658,360 A * 11/1953 Miller ..... F25J 3/0209 48/190
(Continued)

FOREIGN PATENT DOCUMENTS

FR 2503279 A * 10/1982 ..... F04D 27/0269
KR 200318040 Y1 6/2003
(Continued)

OTHER PUBLICATIONS

KR 20110084749 A—machine translation (Year: 2023).*
(Continued)

*Primary Examiner* — Len Tran
*Assistant Examiner* — Kirstin U Oswald
(74) *Attorney, Agent, or Firm* — CARTER, DELUCA & FARRELL LLP

(57) ABSTRACT

A fluid cooling apparatus capable of improving liquefaction efficiency of a fluid by appropriately cooling the fluid in various temperature ranges through a simple process. The fluid cooling apparatus includes an expansion unit including a plurality of expanders, which receive refrigerants through a plurality of paths to expand the refrigerants and discharge the expanded refrigerants having different temperatures, a
(Continued)

heat exchanger receiving the refrigerants having different temperatures from the expansion unit to cool the fluid in multistages, a precompression unit including a plurality of precompressors, which receive the refrigerants passing through the heat exchanger to compress the refrigerants and discharge the compressed refrigerants at the same pressure, a mixing tube configured to mix the refrigerants discharged from the precompression unit to supply the mixed refrigerant, and a main compression unit connected to the mixing tube to compress the mixed refrigerant and supply the compressed refrigerant to the expansion unit.

5 Claims, 4 Drawing Sheets

(51) Int. Cl.

| | |
|---|---|
| ***F25J 1/02*** | (2006.01) |
| ***F25B 31/00*** | (2006.01) |
| ***F25B 41/00*** | (2021.01) |
| ***F25B 1/10*** | (2006.01) |
| ***F25B 3/00*** | (2006.01) |

(52) U.S. Cl.
CPC ..... *F25B 41/00* (2013.01); *F25J 1/005* (2013.01); *F25J 1/0022* (2013.01); *F25J 1/0072* (2013.01); *F25J 1/0204* (2013.01); *F25J 1/0288* (2013.01); *F25J 1/0294* (2013.01); *F25J 1/0298* (2013.01); *F25J 2270/16* (2013.01)

(58) Field of Classification Search
CPC ..... F25B 11/02; F25B 2400/075; F25B 1/10; F25J 1/0022; F25J 1/005; F25J 1/0072; F25J 1/0204; F25J 1/0288; F25J 1/0294; F25J 1/0298; F25J 2270/16; F25J 1/0212; F25J 1/008
USPC ..... 62/411
See application file for complete search history.

(56) References Cited

U.S. PATENT DOCUMENTS 2,663,169 A * 12/1953 Twomey ..... F25J 3/0209 48/190
2,677,945 A * 5/1954 Miller ..... F25J 3/0238 62/622
3,151,469 A * 10/1964 Quick ..... F24F 3/001 62/277
3,494,145 A * 2/1970 Davis ..... F25B 9/06 62/88
3,735,601 A * 5/1973 Stannard, Jr. ..... F25J 1/0097 62/402
3,792,590 A * 2/1974 Lofredo ..... F25J 1/0232 62/48.1
4,267,701 A * 5/1981 Toscano ..... F25J 1/0007 62/402
4,357,153 A * 11/1982 Erickson ..... F25J 3/04351 62/651
4,846,862 A * 7/1989 Cook ..... F25J 1/0072 62/51.1
4,894,076 A * 1/1990 Dobracki ..... F25J 3/04278 62/650
5,137,558 A * 8/1992 Agrawal ..... F17C 9/04 62/612
5,139,547 A * 8/1992 Agrawal ..... F25J 3/04351 62/616
5,768,912 A * 6/1998 Dubar ..... F25J 1/0052 62/912
5,916,260 A * 6/1999 Dubar ..... F25J 1/0204 62/912
6,006,545 A * 12/1999 Tranier ..... F25J 1/0208 62/910
6,220,053 B1 * 4/2001 Hass, Jr ..... F25J 1/0037 62/619
6,250,244 B1 6/2001 Dubar et al.
6,763,680 B2 * 7/2004 Fischer ..... F25J 1/0022 62/612
7,644,595 B2 1/2010 Reddy
8,360,744 B2 * 1/2013 Mirsky ..... F25B 31/00 415/36
9,151,537 B2 * 10/2015 Nilsen ..... F25J 1/0216
9,777,959 B2 * 10/2017 Bonnissel ..... F25J 1/0212
2004/0129020 A1 * 7/2004 Jones, Jr. ..... F25J 1/0274 62/612
2006/0162378 A1 * 7/2006 Roberts ..... F25J 1/0055 62/612
2007/0022718 A1 2/2007 McLaughlin et al.
2008/0006053 A1 * 1/2008 Bauer ..... F25J 1/0217 62/612
2008/0115529 A1 * 5/2008 Ransbarger ..... F25J 1/0085 62/613
2008/0148770 A1 * 6/2008 Migliore ..... F25J 1/0022 62/611
2008/0163645 A1 * 7/2008 Konishi ..... F25J 1/0022 62/620
2009/0113929 A1 * 5/2009 Haukedal ..... F25J 1/0288 62/612
2009/0255294 A1 * 10/2009 Teo ..... F25J 1/021 700/275
2009/0277217 A1 * 11/2009 Ransbarger ..... F25J 3/0233 62/619
2010/0107684 A1 * 5/2010 Minta ..... F25J 1/0297 62/623
2010/0154470 A1 * 6/2010 Nilsen ..... F25J 1/0097 62/611
2010/0162750 A1 * 7/2010 Okaichi ..... F04C 23/008 417/244
2010/0236286 A1 * 9/2010 Nilsen ..... F25J 1/0236 62/640
2013/0192297 A1 * 8/2013 Mak ..... F25J 1/004 62/611
2014/0116084 A1 * 5/2014 Bonnissel ..... F25J 1/0254 62/611
2014/0190205 A1 * 7/2014 Bonnissel ..... F25J 1/0022 62/614
2014/0245780 A1 * 9/2014 Wyllie ..... F25J 1/0057 62/613
2015/0204603 A1 * 7/2015 Sheng ..... F25J 1/0052 62/614
2015/0211788 A1 * 7/2015 Holtzapple ..... F25J 1/0042 62/611
2016/0040927 A1 * 2/2016 Pelagotti ..... F04D 25/163 62/613

FOREIGN PATENT DOCUMENTS

KR 100991859 B1 11/2010
KR 101037249 B1 5/2011
KR 20110084749 A * 7/2011
KR 101056890 B1 8/2011
KR 20120003224 A 1/2012
KR 101153156 B1 6/2012
WO 2011135335 A2 11/2011
WO WO-2011135335 A2 * 11/2011 ..... F25J 1/0022

OTHER PUBLICATIONS

International Search Report issued in corresponding PCT Application No. PCT/KR2017/001019 dated May 1, 2017.
European Search Report issued in corresponding EP Application No. 17815552 dated Jan. 7, 2020.
Roberts et al. "Process Design Solutions for Offshore Liquefaction", GASTECH 2009. The 24th International Conference and Exhibition

(56) References Cited

OTHER PUBLICATIONS for the LNG, LPG and Natural Gas Industries, May 25-28, 2009, Abu Dhabi, May 25, 2009 (May 25, 2009), 13 pages.
Vink et al. "Comparison of Baseload Liquefaction Processes// Comparison Des Procedes De Liquefaction Des Usines De Grande Capacite", International Conference and Exhibition on Liquefied Natural Gas, No. 12, May 4, 1998 (May 4, 1998), pp. 3.6/1-3.6/15.
Australian Examination Report issued in corresponding AU Application No. 2017282588 dated Aug. 12, 2020.

* cited by examiner

FLUID COOLING APPARATUS

TECHNICAL FIELD

The present invention disclosed herein relates to a fluid cooling apparatus, and more particularly, to a fluid cooling apparatus that is capable of improving liquefaction efficiency of a gas with low energy by appropriately cooling the gas in various temperature ranges through a simple process.

BACKGROUND ART

An aqueous mixture extracted from an oil well is separated into water, hydrocarbon-based liquid, and gaseous components in a separator. The gas components separated in the separator forms a natural gas (NG) from which impurities are removed through a pretreatment process of a liquefaction system. The natural gas is supplied to a natural gas liquefaction system and then becomes a liquefied natural gas after a series of processes. Since the natural gas liquefaction system performs liquefaction of the natural gas at a cryogenic temperature, if the natural gas containing heavy hydrocarbon is introduced into the liquefaction system as it is, the natural gas may be frozen to cause failure of the device and also deteriorate liquefaction efficiency of the natural gas. This may be solved before the liquefaction process by a distillation column for removing a low-temperature heavy hydrocarbon.

Also, the natural gas is called at a low temperature to produce the liquefied natural gas. Thus, many developments have been made in the liquefaction process cycle used for the above-described process. For example, a double expander cycle has been developed. However, the double expander cycle increases only cooling efficiency of a fluid by using a plurality of compressors and expanders. Thus, in the double expander cycle, an arrangement relationship of the plurality of compressors is complicated, and operation efficiency is not high.

SUMMARY

Technical Problem

The present invention provides a fluid cooling apparatus in which an arrangement relationship between a plurality of compressor and other devices is simplified, refrigerants having the same pressure are discharged from the plurality of compressors, and the discharged refrigerants are mixed in a single flow and then cooled to be used for liquefying a gas, thereby reducing energy consumed in liquefying the gas.

The object of the present invention is not limited to the aforesaid, but other objects not described herein will be clearly understood by those skilled in the art from descriptions below.

Technical Solution

Embodiments of the present invention provide a fluid cooling apparatus including: an expansion unit including a plurality of expanders, which receive refrigerants through a plurality of paths to expand the refrigerants and discharge the expanded refrigerants having different temperatures; a heat exchanger receiving the refrigerants having different temperatures from the expansion unit to cool the fluid in multistages; a precompression unit including a plurality of precompressors, which receive the refrigerants passing through the heat exchanger to compress the refrigerants and discharge the compressed refrigerants at the same pressure; a mixing tube configured to mix the refrigerants discharged from the precompression unit to supply the mixed refrigerant; and a main compression unit connected to the mixing tube to compress the mixed refrigerant and supply the compressed refrigerant to the expansion unit.

The expanders of the expansion unit and the precompressors of the precompression unit may operate to be interlocked with each other.

The plurality of expanders may include a first expander, a second expander, and a third expander, which expand the refrigerants having different temperatures, and the plurality of compressors may include a first precompressor coaxially connected to the first expander to compress the refrigerant discharged from the first expander, a second precompressor coaxially connected to the second expander to compress the refrigerant discharged from the second expander, and a third precompressor coaxially connected to the third expander to compress the refrigerant discharged from the third expander.

The main compression unit may include a plurality of compressors that are connected in series to each other, and the refrigerants supplied to the mixing tube may be compressed by sequentially passing through the plurality of compressors.

The fluid cooling apparatus may further include a cooler connected to the mixing tube between the precompression unit and the main compression unit to cool the mixed refrigerant.

Advantageous Effects

In the fluid cooling apparatus according to the present invention, the arrangement relationship between the plurality of compressors and other devices may be simplified to improve the operation efficiency of the compressors. Also, the refrigerants having the same pressure may be discharged from the plurality of compressors and then mixed with each other and introduced into the compressors while lowering the temperature of the mixed refrigerant to improve the operation efficiency of the compressors.

Also, the fluid may be cooled at the various temperature ranges by using the compressed refrigerant so that the fluid is efficiently cooled.

DETAILED DESCRIPTION

Figure 1:
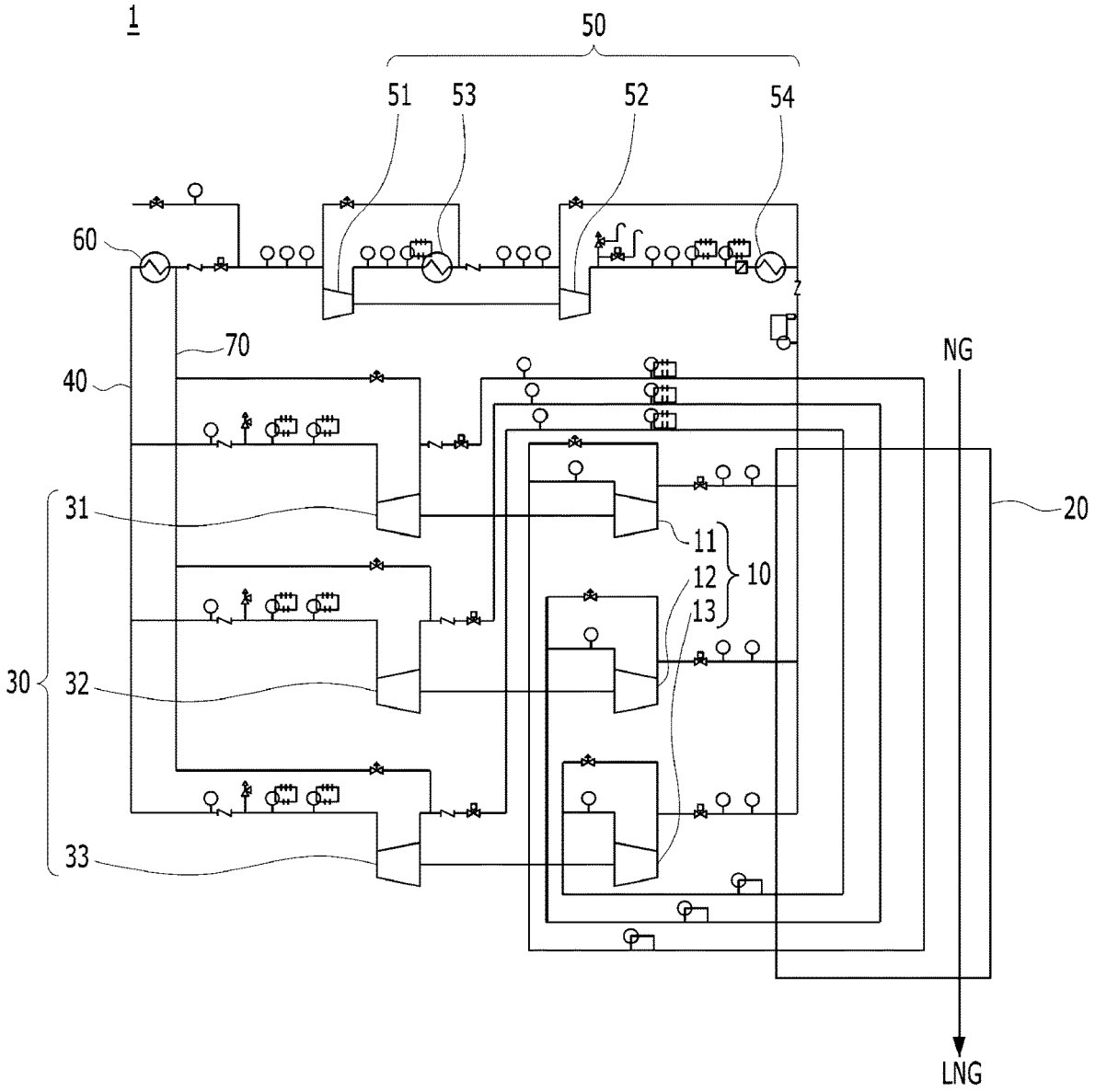
FIG. 1 is a schematic conceptual view of a fluid cooling apparatus according to an embodiment of the present invention.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Further, the present invention is only defined by scopes of claims. Like reference numerals refer to like elements throughout.

Hereinafter, a fluid cooling apparatus according to an embodiment of the present invention will be described in detail with reference to FIG. 1.

FIG. 1 is a schematic conceptual view of a fluid cooling apparatus according to an embodiment of the present invention.

A fluid cooling apparatus 1 according to an embodiment of the present invention cools a fluid having a wide temperature range in a three-stage heat exchange loop to improve liquefaction efficiency of the fluid. More specifically, the fluid cooling apparatus 1 is configured so that refrigerants discharged at different temperatures and pressures in the respective stages are discharged as a refrigerant having the same pressure through a precompressors 31 to 33. Also, the discharged refrigerants are mixed with each other in a mixing tube 40, cooled again in the cooler 60, and compressed in a main compression unit 50. Furthermore, the compressed refrigerant discharged from the main compression unit 50 may be circulated in a heat exchanger 20 to cool the refrigerant in several stages. Particularly, in the fluid cooling apparatus 1, the fluid may be heat-exchanged at a temperature of about −155° C. to about 40° C., and a liquefaction process, which is involved in a process between precooling and subcooling of the fluid, may be more improved in efficiency of liquefaction.

The fluid cooling apparatus 1 may include an expansion unit 10 discharging refrigerants having different temperatures, a heat exchanger 20 connected to one side of the expansion unit 10, a precompression unit 30 receiving the refrigerants discharged from the heat exchanger 20 to discharge refrigerants having the same pressure, a mixing tube 40 mixing the refrigerants discharged from the precompression unit 30, and a main compression unit 50 disposed between the mixing tube 40 and the heat exchanger 20. Furthermore, the fluid cooling apparatus 1 may further include a cooler 60 connected to the mixing tube 40 between the precompression unit 30 and the main compression unit 50.

Hereinafter, components constituting the fluid cooling apparatus 1 will be described in detail.

The expansion unit 10 receives the refrigerants having different amounts through a plurality of paths through the heat exchanger 20 to expand the refrigerants having different temperatures and thereby to supply the refrigerants again to the heat exchanger 20. The expansion unit 10 may include a plurality of expanders, which receive refrigerants having different amounts to discharge refrigerants having different temperatures, i.e., a first expander 11, a second expander 12, and a third expander 13. Here, the expanders 11 to 13 may receive various amounts of refrigerants at different ratios. For example, the first expander 11, the second expander 12, and the third expander 13 may receive the refrigerant of about 30% to about 40%, the refrigerant of about 30% to about 45%, and the refrigerant of about 20% to about 30% of the total amount of refrigerant, respectively. Each of the expanders 11 to 13 may adjust a temperature interval between the refrigerant and the fluid to correspond to an amount of supplied refrigerant, thereby controlling a process of liquefying the fluid. For example, the third expander 13 may adjust a temperature interval between the refrigerant and the fluid in a cold region corresponding to a temperature of about −160° C. to about −90° C. by using the amount of supplied refrigerant to control the subcooling, and the second expander 12 may adjust a temperature interval between the refrigerant and the fluid in an intermediate region corresponding to a temperature of about −120° C. to about −80° C. by using the amount of supplied refrigerant to control the liquefaction. Also, the first expander 11 may adjust a temperature interval between the refrigerant and the fluid in a warm region corresponding to a temperature of about −90° C. to room temperature by using the amount of supplied refrigerant to control the precooling. That is, the expansion unit 10 may easily control all of the precooling, the liquefaction, and the subcooling, which are processes of liquefying the fluid.

The heat exchanger 20 may receive the refrigerants having different temperatures from the expansion unit 10 to cool the fluid in multistages and then discharge the fluid to the outside and discharge the refrigerants to the precompression unit 30. In the heat exchanger 20, a cooling loop for cooling the refrigerants at different temperatures may be formed. That is, in the heat exchanger 20, a warm loop in which the refrigerant having a temperature of about −100° C. to about −80° C., which is supplied from the expansion unit 10, is circulated, an intermediate loop in which the refrigerant having a temperature of about −120° C. to about −80° C. is circulated, and a cold loop in which the refrigerant having a temperature of about −160° C. to about −155° C. is circulated may be formed. In the cold loop, the fluids having different temperature ranges may be cooled to improve heat-exchange between the fluid and the refrigerant.

The precompression unit 30 may include a plurality of precompressors which respectively receive the refrigerants passing through the heat exchanger 20, i.e., a first precompressor 31, a second precompressor 32, and a third precompressor 33. Here, the first precompressor 31 may be coaxially connected to the first expander 11 to compress the refrigerant discharged from the first expander 11, the second precompressor 32 may be coaxially connected to the second expander 12 to compress the refrigerant discharged from the second expander 12, and the third precompressor 33 may be coaxially connected to the third expander 13 to compress the refrigerant discharged from the third expander 13. Thus, when the expanders expand the refrigerants, each of the precompressors may compress the refrigerant discharged from each of the expanders in proportion to a degree of expansion of the refrigerant in each of the expanders. Each of the precompressors and each of the expanders may be interlocked with each other to serve as one compander.

As described above, the precompression unit 30 may receive and compress the refrigerants passing through the heat exchanger 20 to discharge the refrigerants having the same pressure. The discharged refrigerants may be mixed with each other in the mixing tube 40 and then transferred. Here, in the discharged refrigerants having the same pressure, an inflow temperature of each of the expanders, which are respectively connected to the warm loop, the intermediate loop, and the cold loop, a discharge temperature of each of the expanders, which are respectively connected to the warm loop, the intermediate loop, and the cold loop, and a ratio and a maximum pressure of the refrigerant introduced into each of the warm loop, the intermediate loop, and the cold loop may act as variables. Also, energy of the variables may determine a temperature distribution of the cooler 60 and a pressure state of the refrigerant discharged from the precompression unit 30 when energy balance in the heat exchanger is reached. Also, the variables may also influence a temperature of the liquefied natural gas discharged from the heat exchanger 20 and operations of the expansion unit 10 and the precompression unit 30. The precompression unit 30 may continuously discharge the refrigerant having a pressure of about 10 barg to about 20 barg through the variables. Also, the precompression unit 30 always discharges the refrigerant with a predetermined pressure so that the first precompressor 31, the second precompressor 32, and the third precompressor 33 are always driven in a single operation. Thus, the first precompressor 31 to the third precompressor 33 are simplified in control and improved in operation efficiency. Also, the pressures of the discharged refrigerants are the same to improve compression efficiency of the main compression unit 50.

The mixing tube 40 mixes the refrigerants discharged from the precompression unit 30 to supply the refrigerants to the main compressor 50 and the cooler 60. Here, the mixing tube 40 may be connected to one end of each of the precompressors 31 to 33 to receive the refrigerants having the same pressure, which are discharged from the precompressor 31 to 33. Here, the mixing tube 40 may be configured so that the pressure of the refrigerant is constantly maintained. The main compressor 50 is disposed between the mixing tube 40 and the heat exchanger 20 to compress the refrigerant and supply the compressed refrigerant to the heat exchanger 20. In addition, the main compressor 50 may supply the refrigerant to the expansion unit 10. The main compression unit 50 may have a structure in which a first compressor 51 and a second compressor 52 are connected in series to each other, a first cooling unit 53 is connected between the first compressor 51 and the second compressor 52, and a second cooling unit 54 is connected between the second compressor 52 and the heat exchanger 20. The refrigerant supplied into the mixing tube 40 may be compressed and cooled by passing through the components of the main compression unit 50 having the above-described structure in order of the first compressor 51, the second cooling unit 52, the second compressor 52, and the second cooling unit 54.

The cooler 60 may be installed between the precompression unit 30 and the main compression unit 50 and be connected to a cooling supply tube 70 having one end connected to the mixing tube 40 and the other end connected to the other end of the precompression unit 30. The cooler 60 may regularly cool the refrigerant introduced through the mixing tube 40 by using the refrigerant introduced through the cooling supply tube 70 to supply the refrigerant having the constant pressure to the main compression unit 50.

Thus, the cooler 60 may reduce the temperature of the refrigerant, reduce a load generated in the main compression unit 50, and improve the operating efficiency to efficiently compress the whole refrigerant in the main compression unit 50.

Hereinafter, an operation of the fluid cooling apparatus 1 will be described in more detail with reference to FIGS. 2 and 3.

Figure 2:
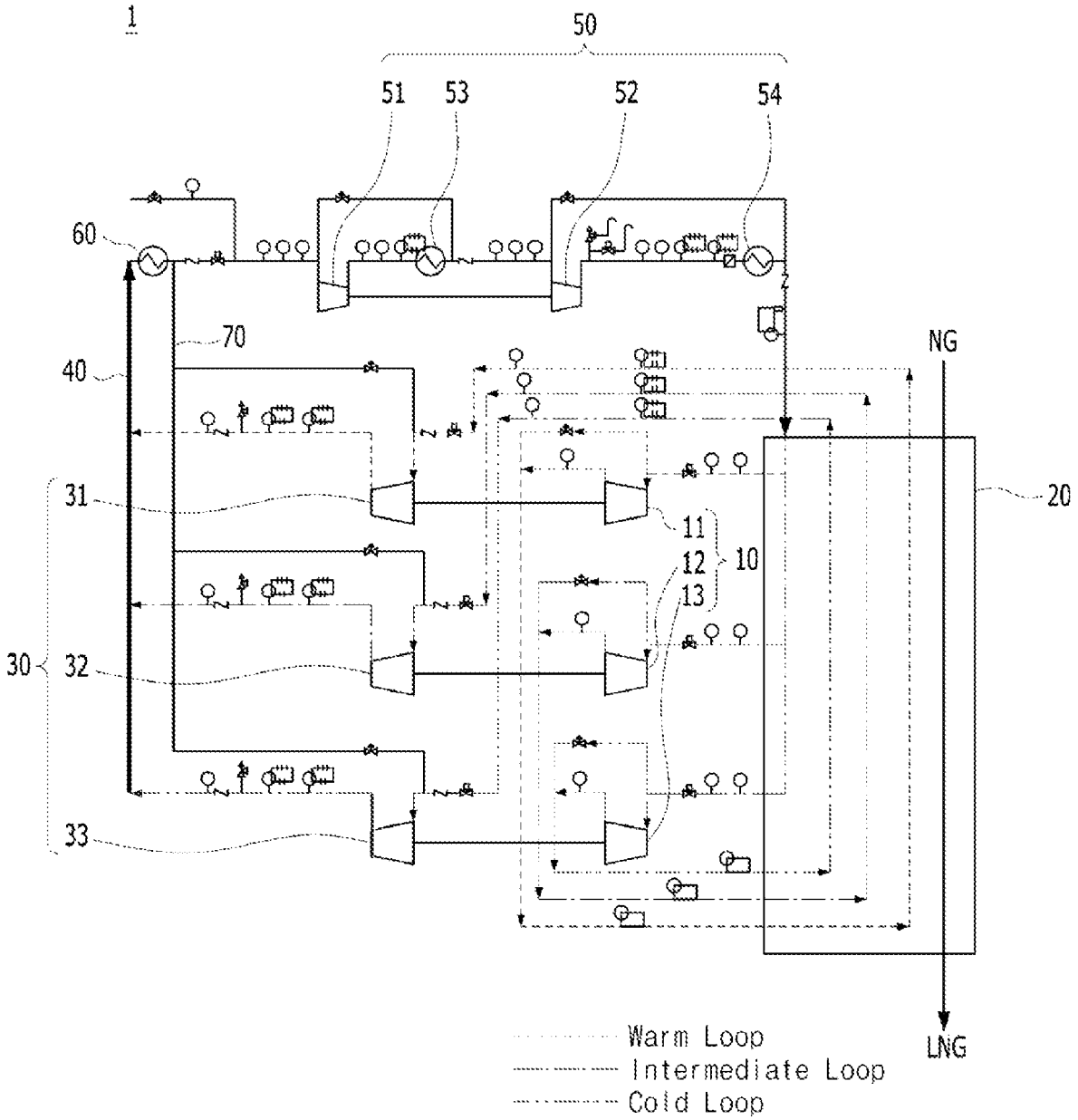
FIGS. 2 and 3 are operation diagrams for explaining an operation of the fluid cooling apparatus.
Figure 3:
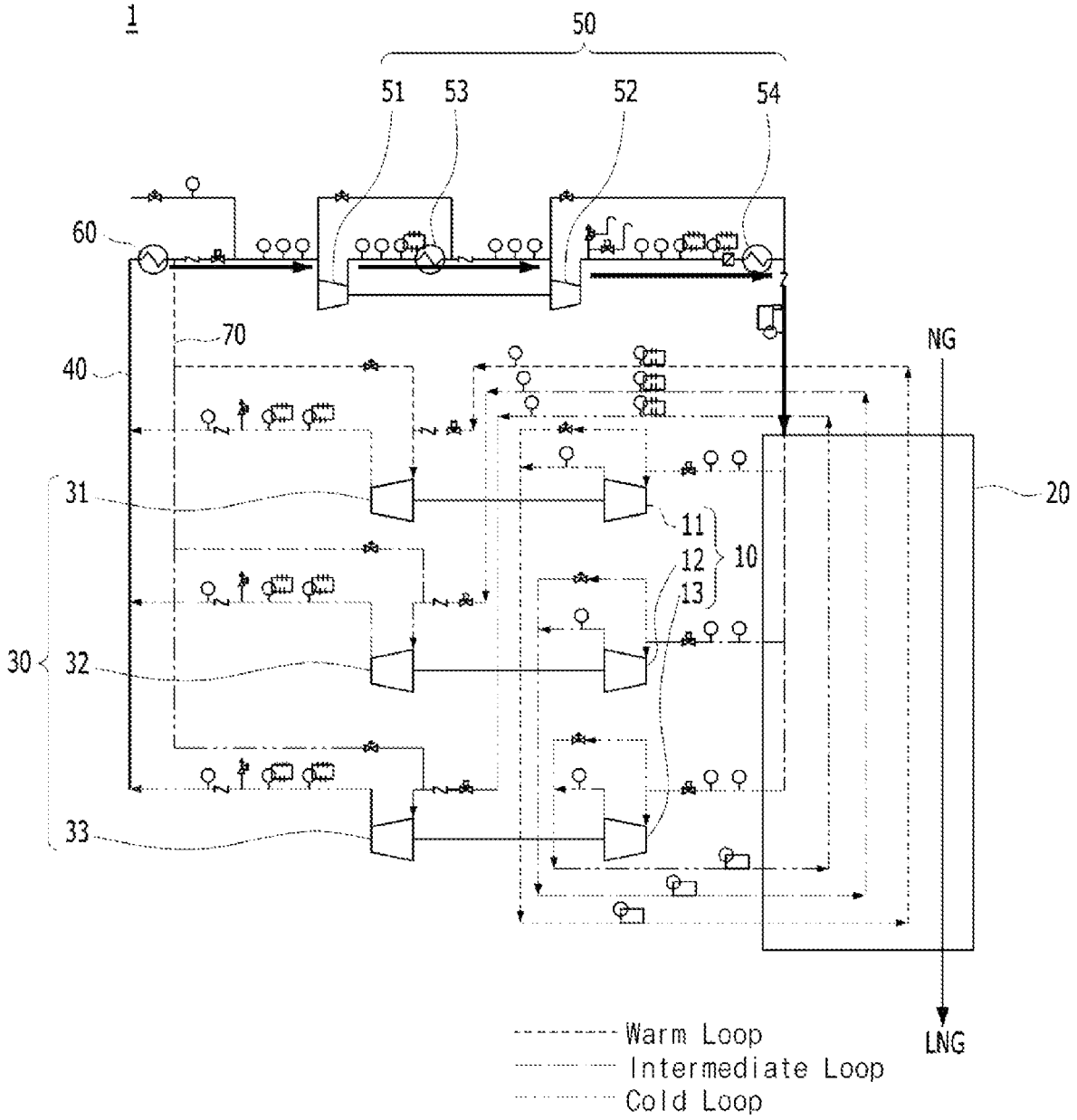

FIGS. 2 and 3 are operation diagrams for explaining an operation of the fluid cooling apparatus.

In the fluid cooling apparatus 1 according to an embodiment of the present invention, the refrigerant discharged from the plurality of precompressors 31 to 33 may be discharged at the same pressure, and the refrigerants discharged from the mixing tube 40 may be mixed with each other into a single compression process to heat-exchange the refrigerant with the fluid, thereby improving the liquefaction efficiency of the fluid. The refrigerant used in the fluid cooling apparatus 1 may be a medium, which achieves a temperature less than a cooling temperature of a target fluid to be cooled, a single refrigerant. For example, the refrigerant may be nitrogen and hydrocarbon.

In this specification, the refrigerant may be, for example, a nitrogen having a pressure of about 10 barg to about 20 barg and a temperature of about 30° C. to about 45° C., which is capable of being maintained in a stable state when compared with other gases. Also, an example in which the fluid cooled by the refrigerant is a natural gas will be described. However, this is merely one example, and the state of nitrogen and the kind of fluid are not limited thereto.

Hereinafter, referring to FIG. 2, the nitrogen refrigerant having a pressure of about 10 barg to about 20 barg and a temperature of about 30° C. to about 45° C. may be compressed from the outside through the first compressor 51 of the main compression unit 50 and then be discharged as a high-temperature refrigerant having a pressure of about 30 barg to about 40 barg. The discharged refrigerant may pass through the first cooling unit 53 and be cooled to a temperature of about 30° C. while passing through the first cooling unit 53. Thereafter, the cooled refrigerant is introduced into the second compressor 52. The second compressor 52 converts the introduced refrigerant into a high-temperature refrigerant having a pressure of about 50 barg to about 60 barg to discharge the converted refrigerant. The discharged refrigerant is cooled to a temperature of about 30° C. again through the second cooling unit 54. Then, the discharged refrigerant is supplied to the heat exchanger 20.

The refrigerant supplied into the heat exchanger 20 may exchange heat with the natural gas and the refrigerant introduced again through the expansion unit 10 while passing through the heat exchanger 20 and be cooled at a temperature of about 5° C. to about 10° C. in the warm loop and cooled at a temperature of about −20° C. to about −40° C. in the intermediate loop. Also, the refrigerant may be cooled at a temperature of about −90° C. to about −120° C. in the cold loop.

As described above, the refrigerant cooled at the different temperatures in the loops may be supplied to the first expander 11 by a ratio of about 30% to about 40%, the second expander 12 by a ratio of about 30% to about 45%, and the third expander 13 by a ratio of about 20% to about 30% through valves disposed between the heat exchanger 20 and the expansion unit 10. The refrigerant supplied into each of the expanders may be discharged through the first expander 11 at a pressure of about 5 barg to about 10 barge and a temperature of about −100° C. to about −80° C., discharged through the second expander 12 at a pressure of about 8 barg to about 15 barge and a temperature of about −120° C. to about −80° C., and discharged through the third expander 13 at a pressure of about 10 barg to about 20 barge and a temperature of about −160° C. to about −155° C.

The refrigerants discharged at the different pressures and temperatures as described above may be introduced again into the heat exchanger 20 to exchange heat with nitrogen introduced from the outside. Here, the nitrogen may be changed to a constant temperature so as to be supplied into each of the expanders 11 to 13. Also, the refrigerant that is treated as described above may be supplied to each of the precompressors 31 to 33, which are interlocked with the expanders 11 to 13, and then be discharged at the same pressure. The discharged refrigerants may be mixed with each other in the mixing tube 40 to form one refrigerant.

Referring to FIG. 3, the mixed refrigerant is cooled through the cooler 60 and lowered to a predetermined temperature. Then, the refrigerant is compressed and cooled by sequentially passing through the first compressor 51, the first cooling unit 53, the second compressor 52, and the second cooling unit 54 and then is introduced into the heat exchanger 20.

Here, the mixed refrigerant is entirely compressed in two stages through the main compression unit 50 and introduced into the heat exchanger 20. Thereafter, the refrigerant continues to cool the fluid in a single stream.

As described above, the flowing refrigerant may be liquefied at a cryogenic temperature of about −160° C. to about −155° C. by the precooling, the liquefaction and the subcooling of the natural gas heat-exchanged with the refrigerant in the heat exchanger 20.

Hereinafter, an operation of the fluid cooling apparatus 1 will be described in more detail with reference to FIG. 4.

Figure 4:
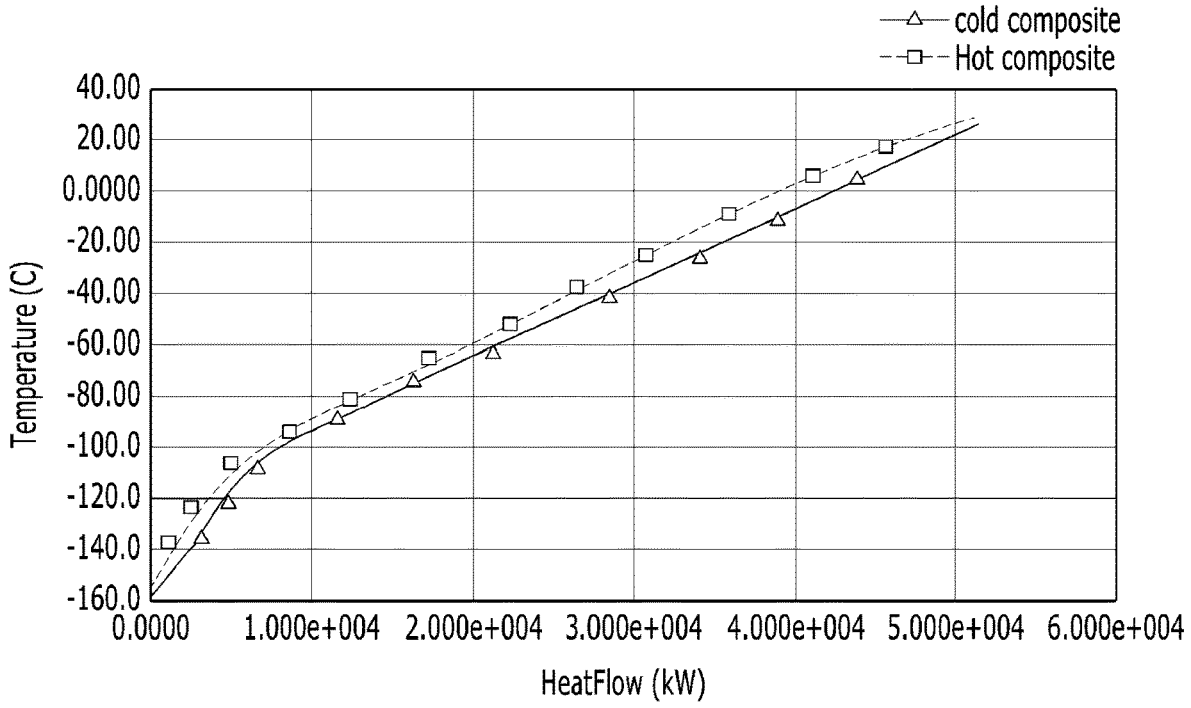
FIG. 4 is a graph illustrating a relationship between a temperature and energy while a fluid is liquefied by using a refrigerant in the fluid cooling apparatus.

FIG. 4 is a graph illustrating a relationship between a temperature and energy while the fluid is liquefied by using the refrigerant in the fluid cooling apparatus.

In the graph, an x-axis represents an amount of heat generated in the heat exchanger through a heat flow of each of the expanders and compressors, and a y-axis represents a temperature of the heat. Also, an upper composite curve represents a hot composite of a fluid, and a lower composite curve represents a cold composite of a refrigerant.

The fluid cooling apparatus 1 of the present invention is constituted by a warm loop, an intermediate loop, and a cold loop. Each of the loops operates in various temperature ranges in consideration of the temperature curves. For example, in the cold loop, the refrigerant may be circulated, and the cold loop may operate to be cooled until reaching a temperature of about 25° C. to about 45° C. after cooled up to a temperature of −160° C. to about −155° C. In the intermediate loop, the refrigerant may be circulated, and the intermediate loop may operate to be cooled until reaching a temperature of about 25° C. to about 45° C. after cooled up to a temperature of −120° C. to about −80° C. Also, in the warm loop, the refrigerant may be circulated, and the warm loop may operate to be cooled until reaching a temperature of about 25° C. to about 45° C. after cooled up to a temperature of −100° C. to about −80° C. The change in amount or ratio of refrigerant circulated through each of the loops may have a significant effect on the temperature curve. In more detail, the change in amount of refrigerant circulated through the cold loop may have a significant effect on a subcooling region between about −160° C. and about −90° C., and the variation in amount of refrigerant circulated through the intermediate loop may have a significant effect on a liquefaction region between about −120° C. and about −80° C. Also, the variation in amount of refrigerant circulated through the warm loop may mainly have an effect on a temperature of about −90° C. or more.

As described above, the fluid cooling apparatus 1 may adjust the amount of refrigerant circulated through each of the loops to control the temperature of each of the loops, thereby effectively reducing the temperature curve interval between the fluid and the refrigerant in the temperature range period that is mainly occupied in each of the loops. Also, since the refrigerants discharged from the precompression unit 30 are mixed with the same pressure and then introduced into the main compression unit 30, the refrigerant may be improved in compression efficiency.

That is, the fluid cooling apparatus 1 may improve the efficiency of the liquefaction of the fluid by improving the compression efficiency of the refrigerant through the simple process and effectively cooling the fluid to reduce the energy consumed for liquefying the fluid.

Although the embodiment of the inventive concept is described with reference to the accompanying drawings, those with ordinary skill in the technical field of the inventive concept pertains will be understood that the present disclosure can be carried out in other specific forms without changing the technical idea or essential features. Therefore, the above-disclosed embodiments are to be considered illustrative and not restrictive.

The invention claimed is:

1. A fluid cooling apparatus comprising:

a heat exchanger to cool a fluid in multistages;

an expansion unit comprising a plurality of expanders configured to receive refrigerants through a plurality of paths through the heat exchanger to expand the refrigerants and supply the expanded refrigerants having different temperatures and pressures to the heat exchanger such that the heat exchanger cools the fluid in multistages using the expanded refrigerants having different temperatures and pressures;

a precompression unit comprising a plurality of precompressors configured to receive the refrigerants which have passed through the heat exchanger to compress the refrigerants and discharge the compressed refrigerants at the same pressure;

a mixing tube with a first end and a second end, the first end of the mixing tube connected to one end of the precompression unit, the mixing tube configured to receive and mix the refrigerants discharged from the plurality of precompressors to supply mixed refrigerant;

a main compression unit connected to the second end of the mixing tube and to the heat exchanger, the main compression unit configured to compress the mixed refrigerant and supply the compressed refrigerant to the heat exchanger;

a cooling supply tube having one end connected to the other end of the precompression unit; and a cooler installed between the precompression unit and the main compression unit to cool the mixed refrigerant from the mixing tube, wherein the other end of the cooling supply tube is connected to the cooler, wherein the expanders of the expansion unit and the plurality of precompressors of the precompression unit are operatively connected to each other, and wherein the precompression unit, the mixing tube, and the main compression unit are sequentially connected.

2. The fluid cooling apparatus of claim 1, wherein the plurality of expanders comprises a first expander, a second expander, and a third expander, which are configured to expand the refrigerants having different temperatures, and the plurality of precompressors comprises a first precompressor coaxially connected to the first expander to compress the refrigerant discharged from the first expander, a second precompressor coaxially connected to the second expander to compress the refrigerant discharged from the second expander, and a third precompressor coaxially connected to the third expander to compress the refrigerant discharged from the third expander.

3. The fluid cooling apparatus of claim 1, wherein the main compression unit comprises a plurality of compressors that are connected in series to each other, and the refrigerants supplied to the mixing tube are compressed by sequentially passing through the plurality of compressors.

4. The fluid cooling apparatus of claim 1, wherein the cooler is further configured to cool the refrigerant received from the mixing tube by using the refrigerant introduced through the cooling supply tube.

5. The fluid apparatus of claim 1, wherein the refrigerant introduced through the cooling supply tube is from the plurality of precompressors of the precompression unit.

* * * * *